US005383393A

United States Patent [19]

Ueda et al.

[11] Patent Number: 5,383,393

[45] Date of Patent: Jan. 24, 1995

[54] MULTICOLOR LITHOGRAPHIC ROTARY PRESS

[75] Inventors: Koichi Ueda; Yuzo Kawarazaki, both of Shizuoka; Noriyuki Shiba, Tokyo; Masayoshi Sato, Kawasaki, all of Japan

[73] Assignee: Kabushikigaisha Tokyo Kikai Seisakusho, Tokyo, Japan

[21] Appl. No.: 61,005

[22] Filed: May 14, 1993

[30] Foreign Application Priority Data

Jul. 29, 1992 [JP] Japan ..... 4-222019

[51] Int. Cl.[6] ..... B41F 5/06; B41F 5/10

[52] U.S. Cl. ..... 101/220; 101/248

[58] Field of Search ..... 101/181, 248, 183, 136, 101/137, 138, 247, 180, 182, 184, 220, 221

[56] References Cited

U.S. PATENT DOCUMENTS 4,696,230 9/1987 Barkley ..... 101/181

FOREIGN PATENT DOCUMENTS 61-182951 8/1986 Japan .
1-313247 12/1989 Japan .
2-13559 1/1990 Japan .
3-1946 1/1991 Japan .

OTHER PUBLICATIONS

Laubscher, "Stacked Modular Press Configurations or Satellites—a Systematic Comparison," *Newspaper Techniques*, Apr. 1988, pp. 64–73.

*Primary Examiner*—J. Reed Fisher
*Attorney, Agent, or Firm*—Foley & Lardner

[57] ABSTRACT

A multicolor lithographic rotary press comprises a plurality of printing sections arranged along a traveling line of paper web, a plurality of register adjusting means, a paper stretching means and a plurality of width adjusting means. Each of the printing sections further includes at least one of divided plate cylinder each divided section of which is independently moved in the axial direction and/or the circumferential direction. The paper stretching means is arranged at the downstream of the printing sections to apply a stretching force to the paper web. The width adjusting means is arranged between two sets of the printing sections to apply an adjusting force to the paper web. The register adjusting means is mechanically connected to each of the divided plate cylinders in the printing sections, and includes an adjusting mechanism for actuating the divided sections in response to a control unit connected to a sensor for detecting the lines and images printed on the paper web by each of the printing sections.

5 Claims, 14 Drawing Sheets

MULTICOLOR LITHOGRAPHIC ROTARY PRESS

BACKGROUND OF THE INVENTION

1. Field of the Invention

The present invention generally relates to a multicolor lithographic rotary press. More particularly, the present invention relates to a multicolor lithographic rotary press which includes B—B type printing sections with divided plate cylinders and dampening means through which a double-width printing paper is successively passed to perform printing operation. In detail the present invention relates to a multicolor rotary lithographic press provided with a plurality of width adjusting means for adjusting the width of the printing paper and a driving roller as an assistance of the width adjusting means. Further each of the printing sections is provided with a registering system for exact placing of lines, images, colors.

2. Description of the Prior Art

A typical conventional lithographic rotary press adapted for a multicolor printing system is, for example shown in FIG. 14 which is a schematically elevational view. This conventional lithographic printing system comprises a plurality of printing sections P each of which includes two pairs of a combination of a plate cylinder PC and a blanket cylinder BC. The blanket cylinders BC of each printing section P are vertically arranged to be in contact with each other. In this conventional printing system, four sets of the printing sections P are horizontally arranged in parallel as shown in FIG. 14. A paper web W is also horizontally travelled through the printing sections in which the paper web W is successively passed between the pairs of the blanket cylinders BC, BC to print both sides of the paper web W.

Another conventional lithographic rotary press for a multicolor printing system is shown in FIG. 15. In this drawing, four printing sets each of which is composed of a plate cylinder PC and a blanket cylinder BC are radially arranged about an impression cylinder IC as a common center cylinder. The blanket cylinders BC are respectively in contact with the impression cylinder IC to form printing sections P. A paper web W is roundly travelled along the circumference of the impression cylinder IC so that the paper web W is successively passed through the four printing sections P defined between the blanket cylinders BC and the impression cylinder IC to print one side of the paper web W.

In recent years, many newspaper publishers have progressed to print newspaper in multicolor inks and thus demanded to perform such the multicolor printing on many pages at a high speed in a limited printing space.

In order to satisfy such the demands, other conventional lithographic rotary presses for a multicolor printing system have been proposed as shown in FIG. 16 and FIG. 17. In these printing systems, each printing section P includes two sets of a blanket cylinder BC and a plate cylinder PC which are symmetrically arranged so as to bring the blanket cylinders BC into contact with each other. A paper web W is vertically travelled through the four printing sections P to print both sides of the paper web W in the same manner as the above described systems. This type printing system is for example shown in "IFRA Newspaper Techniques English Edition", pp. 64 to pp. 73; April, 1988 published by INCA-FIEJ Research Association.

On the other hand, one specific type of multicolor printing apparatus in which a plurality of printing sections are isolated and vertically arranged in multisteps, and which is provided with plural registering and adjusting means to minimize the register errors among lines, images and colors generated by each of the printing sections has been well known in for example Japanese Patent Application Open Publication No.3-1946. The adjusting means of this conventional apparatus includes a shifting mechanism for each plate cylinder of respective printing sections to shift the plate cylinder in its axial direction with respect to a-blanket cylinder.

In conventional art, a B—B type printing apparatus has been also well known. This type apparatus includes four blanket cylinders each of which is accompanied with a plate cylinder and each pair of which are opposed to each other and can be moved in close to and apart from. According to this arrangement, both sides of a paper web are printed on the same occasion.

A general concept of a divided plate cylinder has been well known by one skilled in this art. The divided plate cylinder has a structure that a plate cylinder is divided into two section along its axis, each of which can be independently rotated about the axis with each other.

In cylinder arrangement methods such as a true-rolling cylinder arrangement method and an equal cylinder diameter method, skilled artisans know that the diameter of the plate cylinder arranged with a printing plate is slightly different from that of the blanket cylinder arranged with a blanket.

When a plate cylinder with a printing plate and a blanket cylinder with a blanket are adjacently arranged and driven in the counter directions at the same rotating speed by driving and driven gear units having the same pitch circle diameter and the same gear ratio, and the diameter of the arranged cylinder connected to the driving gear unit is larger than that of the cylinder connected to the driven gear unit, the circumferential surface of the cylinder connected to the driven gear unit sometimes runs idle. In detail, since the circumferential surface of the driven cylinder (blanket cylinder) tends to rotate at the same speed of the driving cylinder (plate cylinder) when they are in contact with each other, the driven cylinder is out of the control function of the driven gear unit. That is, the driven cylinder rotates regardless of the rotating force through the driven gear unit within an allowable phase range corresponding to the backlash of the gear units. The contact phase between the driving cylinder and the driven cylinder is easily affected by an instantaneous change in the contact pressure between these cylinders. This will cause an undesirable idle rotation of the driven cylinder.

In order to produce a clear and sharp printed matter the printing image and line from the plate cylinder must be always transferred to the same place on the blanket cylinder. The above described idle rotation of the blanket cylinder affects the transferred position. In other words, the idle rotation of the blanket cylinder is one of the causes for generating an unclear image such as a double image.

In a conventional B—B type printing apparatus having an ordinary type plate cylinder, Japanese Patent Application Open Publication No. 61-182951 is one of prior arts to prevent the blanket cylinder from generating the idle rotation.

Further, Japanese Patent Application Open Publication Nos. 1-313247 and 2-13559 disclose an improved roller which comprises a support shaft fixed on a stationary member, an outer tubular member rotatably supported by the support shaft and a rotatable member capable of relatively rotating with respect to the stationary member. The outer tubular member and the rotatable member are rotated about the support shaft by electric power.

Paper webs used in various printing systems are generally produced in such manner that pulp fibers are mechanically cut and broken into fine particles; dispersed in water; dehydrated and dried; and finally adhered by hydrogen-bond to form paper in a web or sheet figure. Under moisture condition, each of pulp fibers tends to extend a little less than 1 percent in its longitudinal direction and 20 to 30 percent in its radius direction. Thus paper web is extended in its longitudinal and width directions by dampening and/or watering operation. Most of the pulp fibers of general mechanically produced paper webs are orientated in the longitudinal direction of paper web, so that paper webs are remarkably extended in their width direction.

In a specific lithographic printing system employing dampening operation in printing section, a paper web is swelled by the water supplied during the dampening operation. Therefore the image and lines printed on the paper web are also deformed in response to the swell of the paper web. In the printing systems including at least two lithographic printing sections each of which is associated with dampening means to successively print color images on the same paper web, the printed images or lines formed at the first printing section are not correctly coincided with the images or lines formed at the second and later printing sections. Accordingly, this will produce printed materials with a poor quality.

The conventional technique shown in the aforesaid Japanese Patent Application Open Publication No. 3-1946 provides a width adjusting mechanism to minimize the generation of register errors on account of the expansion in a paper web, especially in the width direction of the paper web due to water. This concept is effective to a multicolor printing system using many types of paper web.

In newspaper printing works, a part of printing plates should be frequently replaced by a new plate because the newspaper composition depends on distributing area and the information currently reported. Normally used printing systems need to temporarily stop the printing operation to perform this partially replacing work of the printing plate, and after this work to start the printing operation. During this replacing work, the change of the printing speed, i.e., deceleration, stop and acceleration, affects the stretching force applied to the paper web in its longitudinal direction. This will cause register errors in the longitudinal (traveling) direction of the paper web in multicolor printing. Further fine register errors generated during from the plate producing step to the plate setting step are magnified to undesirable register errors which produce many damaged papers.

A conventional B—B type printing apparatus includes divided plate cylinders each of which is provided with a drive unit as shown in FIG. 18. This type cylinder drive unit can not resolve the generation of undesirable idle rotation. FIG. 18 shows a partially sectional plan view of two sets of divided plate cylinders and blanket cylinders. One plate cylinder is divided into an inside plate section PCa (PCa') and an outside plate section PCb (PCb'). The divided cylinder PCa, PCb and a blanket cylinder BC are oppositely arranged between side frames 203 and 204, and they can be moved close to or apart from each other. The external diameter of the blanket cylinders BC, BC' is slightly larger than that of the divided plate cylinders PCa, PCb, PCa', PCb'.

The drive unit shown in FIG. 18 includes a power transmission gear 205 connected to a power unit, a first gear 206 connected to the power transmission gear 205 and fixed to one end of the shaft of the inside plate cylinder PCa, and a second gear 207 connected to the first gear 206 and fixed to one end of the shaft of the blanket cylinder BC. According to this gear engagement, the inside plate cylinder PCa and the blanket cylinder BC are in close with each other and respectively rotated in the counter directions. Since the inside plate cylinder PCa having a smaller diameter functions as a driving roller which drives the blanket cylinder BC having a larger diameter, the driven cylinder BC does not generate the undesirable idle rotation.

The second gear 207 is further engaged with a third gear 208 rotatably mounted on one end of the shaft of the blanket BC'. The third gear 208 is engaged with a fourth gear 209 fixed to one end of the shaft of the inside plate cylinder PCa'. The fourth gear 209 is engaged with a driven gear- 210 fixed to one end of the shaft of the blanket cylinder BC'. According to this gear engagement, the inside plate cylinder PCa' and the blanket cylinder BC' are in close with each other and respectively rotated in the counter directions. Since the inside plate cylinder PCa' having a smaller diameter functions as a driving roller which drives the blanket cylinder BC' having a larger diameter, the driven cylinder BC' does not generate the undesirable idle rotation.

On the other hand, the outside plate cylinders PCb and PCb' are provided with driven gears 212 and 214 through their shafts, respectively. The driven gears 212 and 214 are respectively engaged with gears 211 and 213 fixed to the other end of the shafts of the blanket cylinders BC and BC'. According to this gear engagement, since the outside plate cylinders PCb and PCb' having a smaller diameter function as driven rollers which are driven by the blanket cylinders BC and BC' having a larger diameter, the driven cylinders PCb and PCb' generate the undesirable idle rotation so that double lines and images are printed.

BRIEF SUMMARY OF INVENTION

It is therefore a primary object of the present invention to provide an improved multicolor lithographic rotary press which can automatically correct register errors.

Another object of the present invention is to provide an improved multicolor lithographic rotary press which is free from generating undesirable idle rotation between plate cylinders and blanket cylinders.

Another object of the present invention is to provide an improved multicolor lithographic rotary press which can produce clear and sharp printed materials whose lines and images are exactly consistent with each other.

To accomplish the above described objects, a multicolor lithographic rotary press according to the present invention comprises a plurality of printing sections arranged along a traveling line of paper web, a plurality of register adjusting means, a paper stretching (or drawing) means and a plurality of width adjusting means.

Each of the printing sections further includes at least one of divided plate cylinder each divided section of which is independently moved in the axial direction and/or the circumferential direction. The paper drawing means is arranged at the downstream of the printing sections and includes at least one pair of rollers whose circumferential surfaces are in contact with the paper web to apply a stretching force to the paper web. The width adjusting means is arranged between two sets of the printing sections to apply an adjusting force to the paper web. The register adjusting means is mechanically connected to each of the divided plate cylinders in the printing sections, and includes an adjusting mechanism for actuating the divided sections in response to a control unit connected to a sensor for detecting the lines and images printed on the paper web by each of the printing sections.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENT

One preferred embodiment, as the first embodiment, of the present invention will be described in detail with reference to the accompanying drawing FIG. 1.

Figure 1:
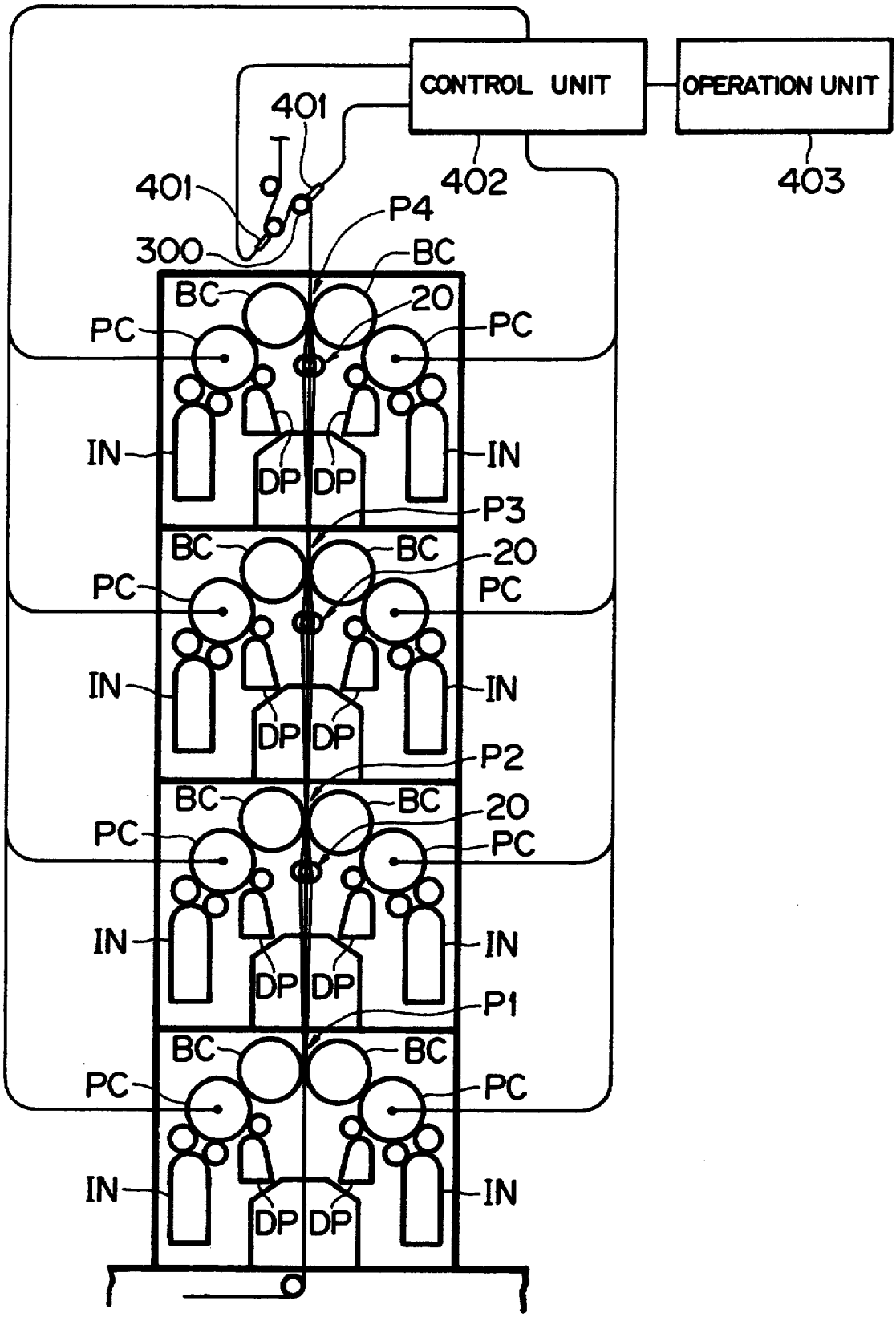
FIG. 1 is a schematic illustration showing an overall construction of a multicolor lithographic rotary press according to the present invention.
Figure 17:
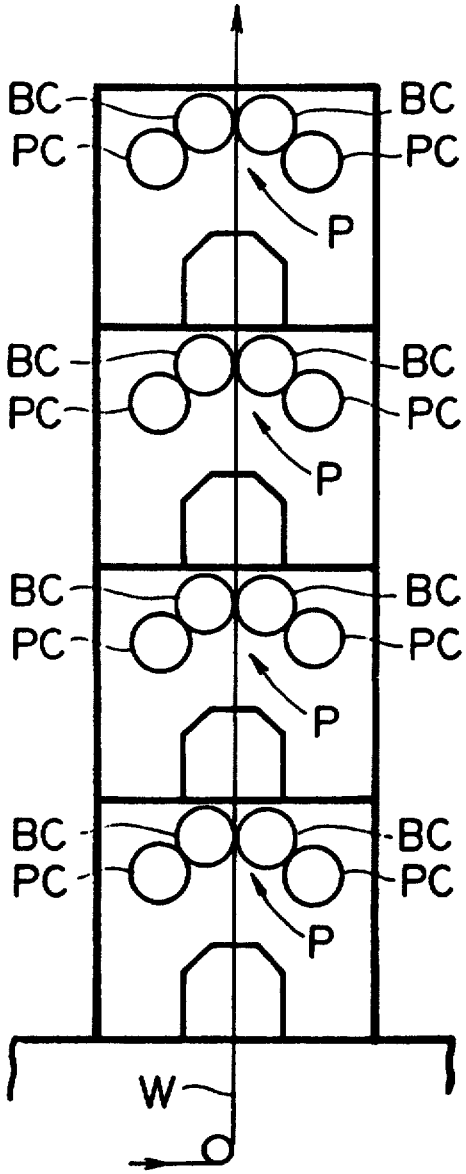
FIG. 17 PRIOR ART
FIG. 17 is a schematic illustration showing an overall construction of still another example of conventional lithographic rotary press.

In FIG. 1, there is shown an overall constitution of lithographic printing apparatus such as a rotary offset press which comprises first to fourth printing sections P1, P2, P3 and P4 vertically arranged in the same manner as the above described conventional multicolor lithographic rotary press shown in FIG. 17. Each printing section includes two sets of a blanket cylinder BC and a plate cylinder PC which are symmetrically arranged so as to bring the blanket cylinders BC into contact with each other. A paper web W is vertically travelled from the first printing section P1 to the fourth printing section P4. Each of the plate cylinders PC is divided into two sections in the axial direction and the divided plate sections are respectively moved in the axial direction and/or in the circumferential direction. Further, the rotary press comprises a paper drawing means 300 arranged at the downstream of the fourth printing section P4, as described later and a plurality of web width adjusting devices 20 each of which is arranged between two sections of the printing sections P1, P2, P3 and P4, described later in detail. Further, this printing apparatus comprises, at the downstream of the paper drawing means 300, a sensor 401 for detecting any reference marks such as a register mark printed on the paper web by the printing sections P1, P2, P3 and P4, and a control unit 402 for controlling the registering operation in the printing sections P1, P2, P3 and P4.

In FIG. 1, IN and DP represent an inking unit and a dampening unit, respectively.

Figure 2:
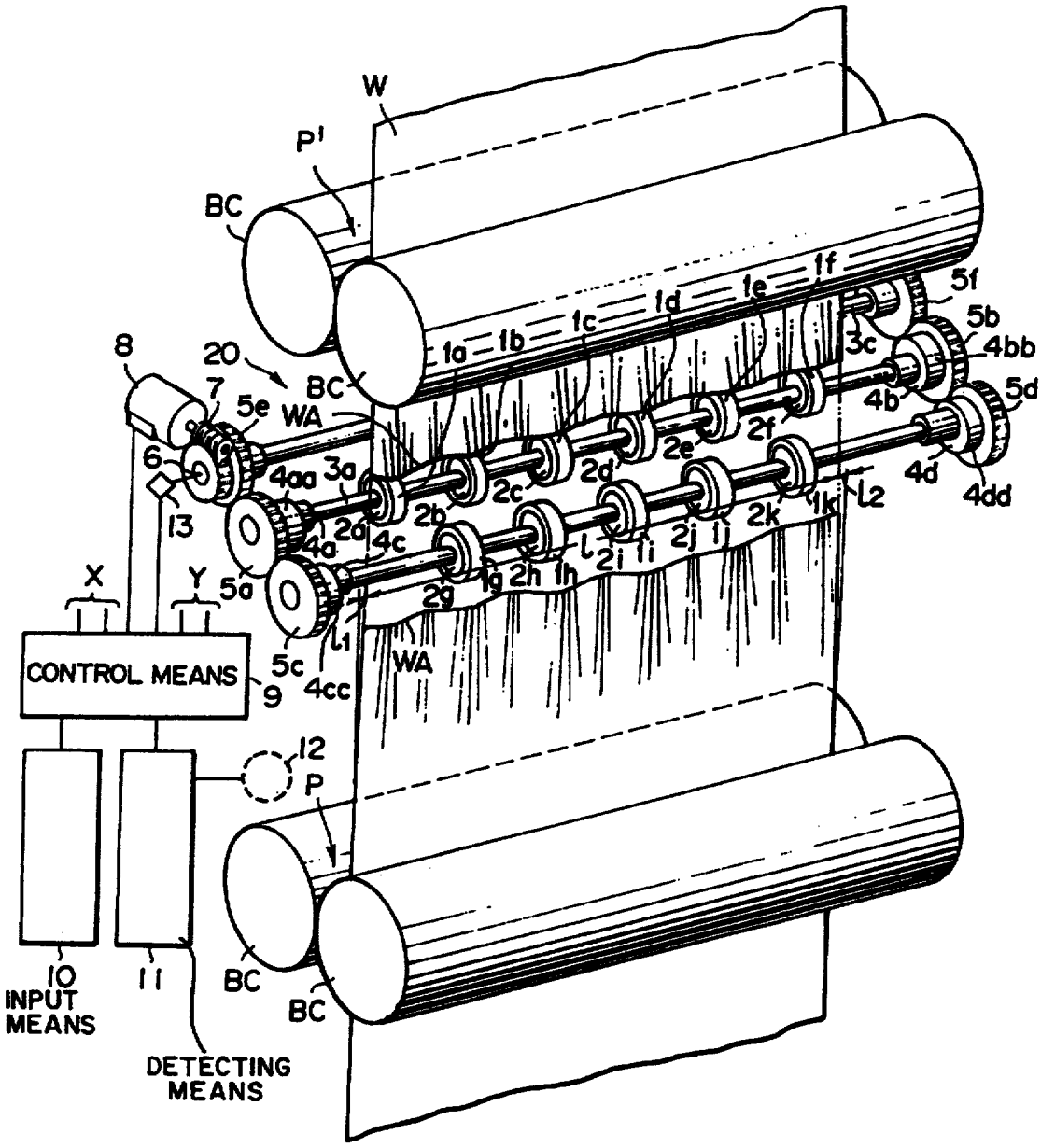
FIG. 2 is a schematically perspective view showing one example of a web width adjusting device used in the multicolor lithographic rotary press shown in FIG. 1.

The web width adjusting device 20 is typically shown in FIG. 2, wherein the device 20 comprises a pair of contact means between which the paper web W is travelled. Each of the contact means includes a plurality of contact members. This embodiment uses contact rollers for these contact members. In detail, the contact rollers are respectively composed of contact surfaces 1*a*, 1*b*, 1*c*, 1*d*, 1*e* and 1*f*; and 1*g*, 1*h*; 1*i*, 1*j*, and 1*k*, which are circumferential surfaces of roller members 2*a*, 2*b*, 2*c*, 2*d*, 2*e* and 2*f*; and 2*g*, 2*h*, 2*i*, 2*j* and 2*k*. In a first series of the roller members 2a to 2f, they are isolated each other at a regular interval and rotatably assembled on a first shaft 3a. In a second series of the roller members 2g to 2k, they are also isolated each other at a regular interval and rotatably assembled on a second shaft 3b. The roller members 2g to 2k of the second series are respectively shifted half of the interval between the roller members of the first series, so that each roller members of the second series is positioned at the center of two roller members of the first series as shown in FIG. 2.

The first and second shafts 3a and 3b are eccentrically supported at their both ends by eccentric sleeves 4a and 4b; and 4c and 4d, respectively. These eccentric sleeves 4a to 4d are rotatably mounted on a frame, not shown, through end members 4aa, 4bb, 4cc, and 4dd. Further, the eccentric sleeves 4a to 4d are respectively provided at their ends with end gears 5a, 5b, 5c and 5d which are rotated with their connected eccentric sleeves 4a to 4d. The end gears 5a and 5c, at the same ends, are meshingly engaged with each other, and the end gears 5b and 5d, at the other ends, are also meshed with each other.

3c is a shaft which is provided in parallel with the shaft 3a, 3b and rotates freely. Both ends of the shaft 3c are provided with end gears 5e and 5f which are meshed with said end gears 5a, 5b and are integrally rotated with the shaft 3c. One end of the shaft 3c is further provided with a worm wheel 6 which is integrally rotated with the shaft 3c. The worm wheel 6 is meshed with a worm 7 fixed to a shaft of a driving means 8.

The driving means 8 is controlled by a control means 9 which is electrically operated by an input means 10 such as a key board and a detecting means 11 by which various operation information such as speed of a main motor 12 representing traveling speed of the paper web W. The control means 9 is further electrically connected to another detecting means 13 for detecting rotational phase of the driving means 8 and the eccentric sleeve 4a (4b, 4c, 4d). Further the control means 9 is connected to the driving means and to the detecting means for detecting rotational phase of the driving means and the eccentric sleeve of the other web width adjusting means, not shown, through lines X and Y, respectively.

Alternatively, the control means 9 may be communicated with these detecting means and driving means by any conventional radio means.

In FIG. 2, the printing sections are represented by P and P', and the blanket cylinders are represented by BC.

Figure 3:
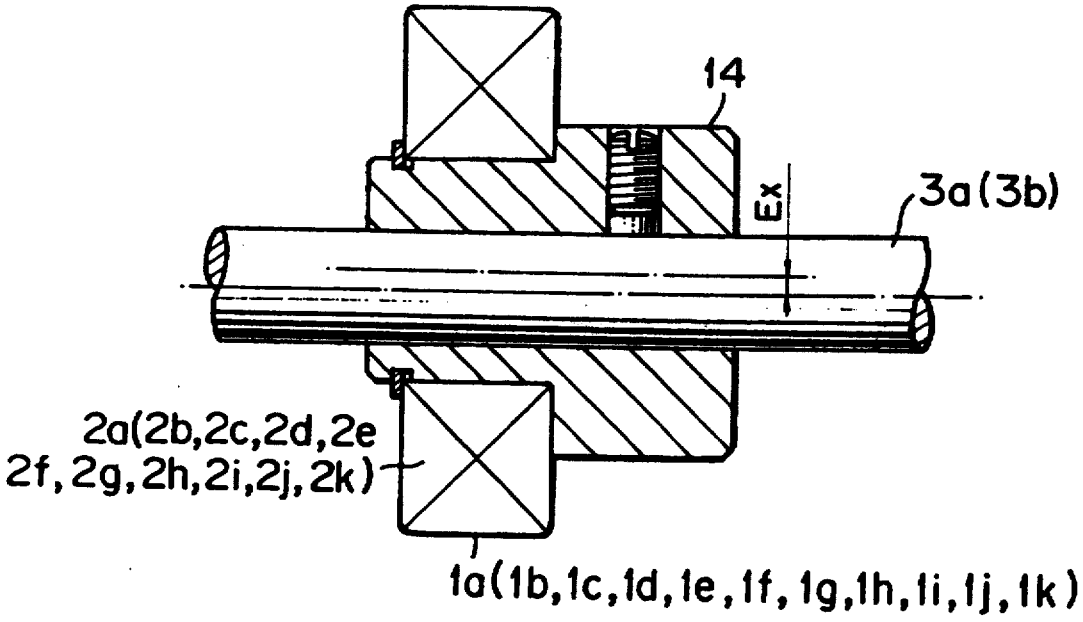
FIG. 3 is a schematically sectional view showing another example of a web width adjusting device used in the multicolor lithographic rotary press shown in FIG. 1.

FIG. 3 shows another embodiment of a web width adjusting device according to the present invention, wherein another eccentric member 14 is used for positioning contact means to the surface of traveling paper web W.

In the web width adjusting device shown in FIG. 1, the shafts 3a and 3b are moved by rotating motion of the eccentric sleeves 4a to 4d supporting the shafts 3a and 3b, and thus the roller members 2a to 2k assembled on the shafts 3a and 3b are simultaneously moved. On the other hand, the embodiment shown in FIG. 3 employs the eccentric member 14 which allows the roller members 2a to 2k to be eccentrically supported by the shafts 3a and 3b independently, and therefore the contact surfaces of the roller members 2a to 2k can be independently positioned to the surface of the traveling paper web W.

Figure 4:
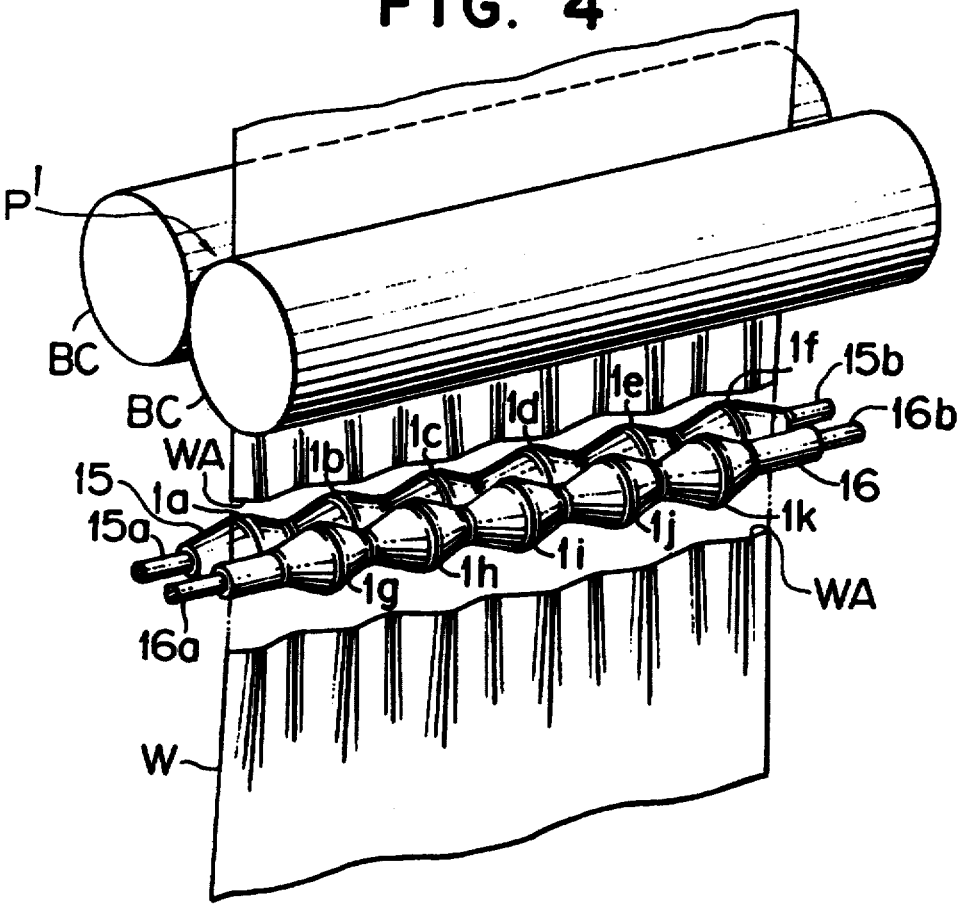
FIG. 4 is a schematically perspective view showing the other example of a web width adjusting device used in the multicolor lithographic rotary press shown in FIG. 1.

FIG. 4 shows other embodiment of a web width adjusting device according to the present invention, wherein a pair of knaggy rollers 15 and 16 are oppositely arranged at both sides of the paper web W. The knaggy rollers 15 and 16 include a plurality of convex contact surfaces 1a to 1f and 1g to 1k, respectively. The knaggy rollers 15 and 16 are rotatably supported by eccentric sleeves, not shown, through their shaft ends 15a, 15b and 16a, 16b and bearings, not shown.

The eccentric sleeves used in this embodiment are driven in the same manner as the former embodiment shown in FIG. 2.

Figure 5:
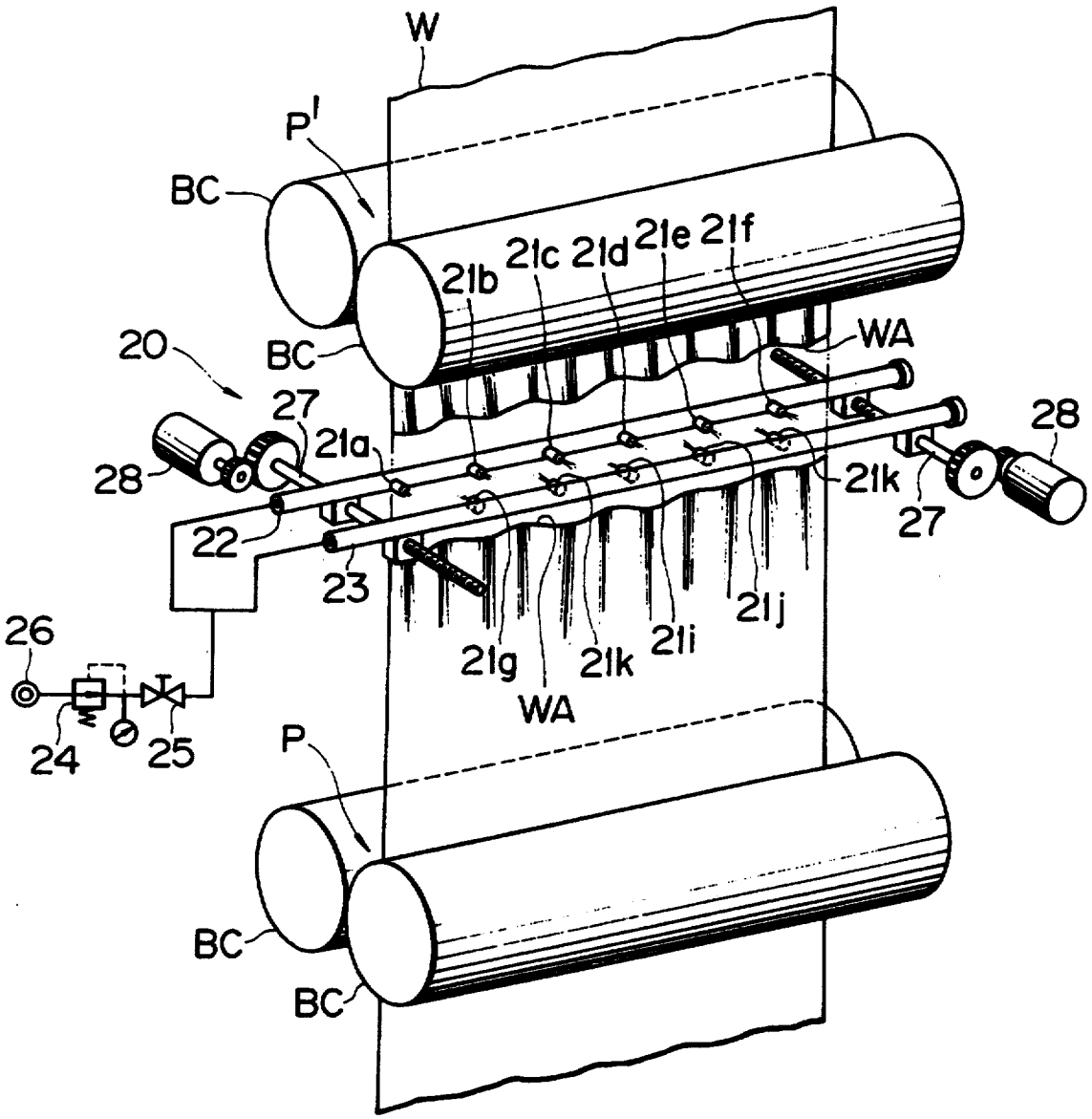
FIG. 5 is a schematically perspective view showing further the other example of a web width adjusting device used in the multicolor lithographic rotary press shown in FIG. 1.

FIG. 5 shows further other embodiment of a web width adjusting device 20 according to the present invention, in which a pair of fluid injecting means 22 and 23 are oppositely arranged so that the paper web W is passed through therebetween. The fluid injecting means 22 and 23 includes a plurality of injection nozzles 21a to 21k, and communicated with a fluid source 26 through a regulator 24 and a valve 25 by means of which the pressure and/or amount of the fluid injected from the fluid injecting means 22 and 23 are adequately controlled. The fluid injecting means 22 and 23 are respectively supported by screwed guide shafts 27 and 27 which are meshingly engaged with drive units 28 and 28. According to this mechanism, the fluid injecting means 22 and 23 can be moved along the guide shafts 27 and 27 in response to the rotation of the guide shafts 27 and 27. For this fluid, a compressed air is preferably used.

A typical operation of the printing system using the web width adjusting devices will be described in conjunction with FIG. 2 to FIG. 4.

The paper web W is set in the printing system in such that the web W is successively travelled through the printing sections P1, P2, P3, and P4 with passing through between the first series of the contact surfaces 1a to 1f and the second series of the contact surfaces 1g to 1k of the web width adjusting devices 20.

After or prior to the above described work, required information on the paper web such as width, material, thickness, and the like are input into the control means 9 through the input means 10. The control means 9 outputs an actuating signal to the driving means 8 which drives the eccentric sleeves 4a to 4d with reference to the detected signal from the detecting means 13 so that the contact surfaces la to 1k are set at their initial positions predetermined in response to the web information.

Then a start switch, not shown, for the printing system is turned on to start traveling the paper web W and printing operation of the printing sections P1, P2, P3, and P4.

As the printing sections begin their rotational work, the detecting means 11 detects the rotating speed of the main motor 12, representing the traveling speed of the paper web W, and inputs the detected information to the control means 9. According to the information on the traveling speed of the paper web W corresponding to the rotating speed of the main motor 12, the control means 9 outputs an adjusting signal to shift the contact surfaces la to 1k from their initial positions to predetermined adjusting positions.

In the web width adjusting device 20 shown in FIG. 5, the web W is successively travelled through the printing sections P1, P2, P3, and P4 with passing through between the first series of the fluid injection nozzles 21a to 21f and the second series of the fluid injection nozzles 21g to 21k. In response to the operation of the printing apparatus, the regulator 24 and/or the valve 25 are adequately controlled to adjust the pressure and/or amount of the fluid injected from the injection nozzles 21*a* to 21*k*. On the same occasion, the drive units 28 and 28 are actuated to rotate the guide shafts 27 and 27 for adjusting the distance between the injection nozzles 21*a* to 21*k* and the paper web W.

The regulator 24 and/or the valve 25 may be provided with an automatic control means, not shown, which automatically control the regulator 24, the valve 25, and/or the drive units 28 and 28 in the same manner as the control system shown in FIG. 1.

At the first printing section P1, the first image is printed on the paper web W and simultaneously blank sections of the printed web is supplied with dampening water through the blanket surface of the blanket cylinder BC. Thus wetted fibers of the paper web W become gradually extending in the width direction of the web W during traveling from the first printing section P1 to the succeeding printing section; i.e., second printing section P2. When the web W is passed through the web width adjusting device 20 prior to the second printing section P2, the web W is subjected to contacting pressure by the contact surfaces 1*a* to 1*k* so that the web W is deformed in a wavy surface WA. The wavy surface WA allows the primary width of the paper wave W to be decreased 11, 12.

Although the wavy surface WA gradually returns to its primary shape after passing the web width adjusting device 20, the web width cannot be completely returned to its primary width at the succeeding printing section (P2) and thus the paper web W with slightly smaller than its primary width is entered into the succeeding printing section (P2). Therefore the extended width due to the dampening water at the preceding printing section (P1) may be cancelled by this shortened width. As a result, the paper web W without any faults such as visible wrinkles and the like is printed at the second printing section P2 so that the succeeding image can be printed in consistent with the preceding image. On the same occasion, the blank section of the paper web is supplied with dampening water through the blanket surface of the blanket cylinder BC in the same manner as the first printing section P1.

Next, the paper web W is successively travelled to the succeeding printing section; i.e., the third printing section P3 through another web width adjusting device 20 arranged prior to the third printing section P3. In this web width adjusting device 20, the paper web W is also subjected to the same adjusting operation as the former adjusting means.

In each of the web width adjusting devices 20, the positions of the contact surfaces 1*a* to 1*k* against the paper web W should be adequately adjusted in response to the traveling speed of the paper web W because the wetted fibers will expand in proportion to time. In other words, the contact surfaces 1*a* to 1*k* should be largely shifted when the paper web W is travelled at a slow speed.

According to the web width adjusting device 20, the web width at the succeeding printing section P' (P2, P3, P4) can be adjusted in consistent with that of the preceding printing section P (P1, P2, P3). Thus the image-lines printed at the first to fourth printing sections P1 to P4 can be formed in consistent with each other.

In experimental test executed by the present applicant, a rolled newspaper type A (width 1626 mm) was used to clarify the difference between the effect obtained by the web width adjusting device 20 arranged as shown in FIG. 1 and that of conventional constitution without any web width adjusting means. This experimental test evidenced that register errors (about 2 mm) generated in the width direction between the first printed image line and the fourth printed image line by conventional constitution can be wholly corrected by the web width adjusting device 20 according to the present invention. Although the expanding ratio in the web width depends on type of paper web, the web width adjusting device according to the present invention can adequately compensate such register errors.

The automatic control means 9 may be replaced by any manual control means.

The present invention is not limited to only the above described embodiments, and therefore for example the contact surfaces 1*a* to 1*k*; and the fluid injecting means 22 and 23 of the web width adjusting device 20 may be modified in any adequate shapes and numbers. Further the control means 9 may be input with the information on the dampening water fed onto the paper web W at the printing sections P1 to P3; i.e., ratio between image and blank to be printed at the printing sections P1 to P3. Various changes and modifications are possible without departing from this concept of the invention.

The paper drawing means 300 used in the printing system shown in FIG. 1 according to the present invention will be described with referring to FIG. 6.

Figure 6:
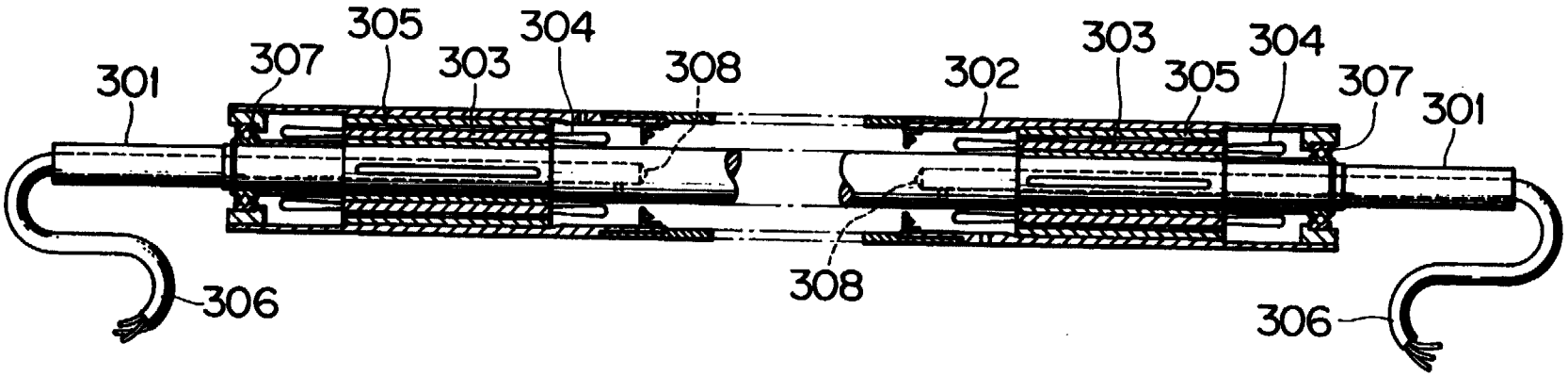
FIG. 6 is schematically sectional view showing one example of a paper drawing means used in the multicolor lithographic rotary press shown in FIG. 1.

FIG. 6 shows a sectional view of one example of the paper drawing means 300 which comprises a support shaft 301 capable of being fixed to a frame member, not shown, of the printing apparatus. The support shaft 301 supports an external tubular member 302 through a pair of bearings 307 at each end of the tubular member 302. The support shaft 301 further includes a pair of stationary members 303, 303 which are arranged inner than the bearings 307 and 307. Each of the stationary members 303 is provided with a coil wire 304 which is electrically connected to a lead member 306. The lead member 306 is installed in an axial hollow space 308 formed in the support shaft 301 along its axis.

The external tubular member 302 includes a pair of rotators 305 with a conductor, not shown, fixed to the inner wall of the tubular member 302. The rotator 305 is opposed to the stationary member 303 through a small gap therebetween.

The lead member 306 is electrically connected to a power unit via a control unit, not shown. The control unit is further communicated with a control signal generator, not shown, and a speed detecting means for detecting the circumferential speed of the external tubular member 302 corresponding to the stretching degree of the paper drawing means 300.

In the above described structure of the paper drawing means 300, the coil wire 304 of the stationary member 303 is supplied through the lead member 306 with AC energy whose frequency is controlled in response to the control signal from the speed detecting means to generate magnetic field. This magnetic field applies force to the conductor of the rotator 305 at right angles with respect to the magnetic flux caused by the conductor and the coil wire 304 of the stationary member 303. Thus the rotator 305 is revolved in the same direction of the magnetic field and the external tubular member 302 fixed with the rotator 305 is rotated about the support shaft 301.

During the rotation of the external tubular member 302, the speed detecting means detects the circumferential speed of the external-tubular member 302 and transmits the detected signal to the control unit. The control unit compares this detected signal with a predetermined value. If they are not equal, the control unit outputs an adjusting signal to make the speed of the external tubular member 302 to be equal to the predetermined value.

In a preferable mode, the control signal generator is actuated in response to an output signal from a paper tension detecting means, not shown, to drive the paper drawing means in consistency with the traveling condition of the paper web.

According to this paper stretching mechanism, if the paper web W is released from the engagement with the pair of the blanket cylinders BC, BC in the printing section P4 and the tension applied to the paper web W is suddenly decreased or eliminated, the stretching force by the external tubular member 302 of the paper stretching means 300 can compensate for the paper web in its normal traveling state.

Since the external tubular member 302 of the above described paper stretching means 300 does not idle-run on the paper web W, the printed surface of the paper web W is prevented from abrading due to contact with the external tubular member 302.

The paper drawing means 300 is not limited to only the above described structure, and therefore various modifications are possible, for example any drive mechanism may be employed.

Figure 7:
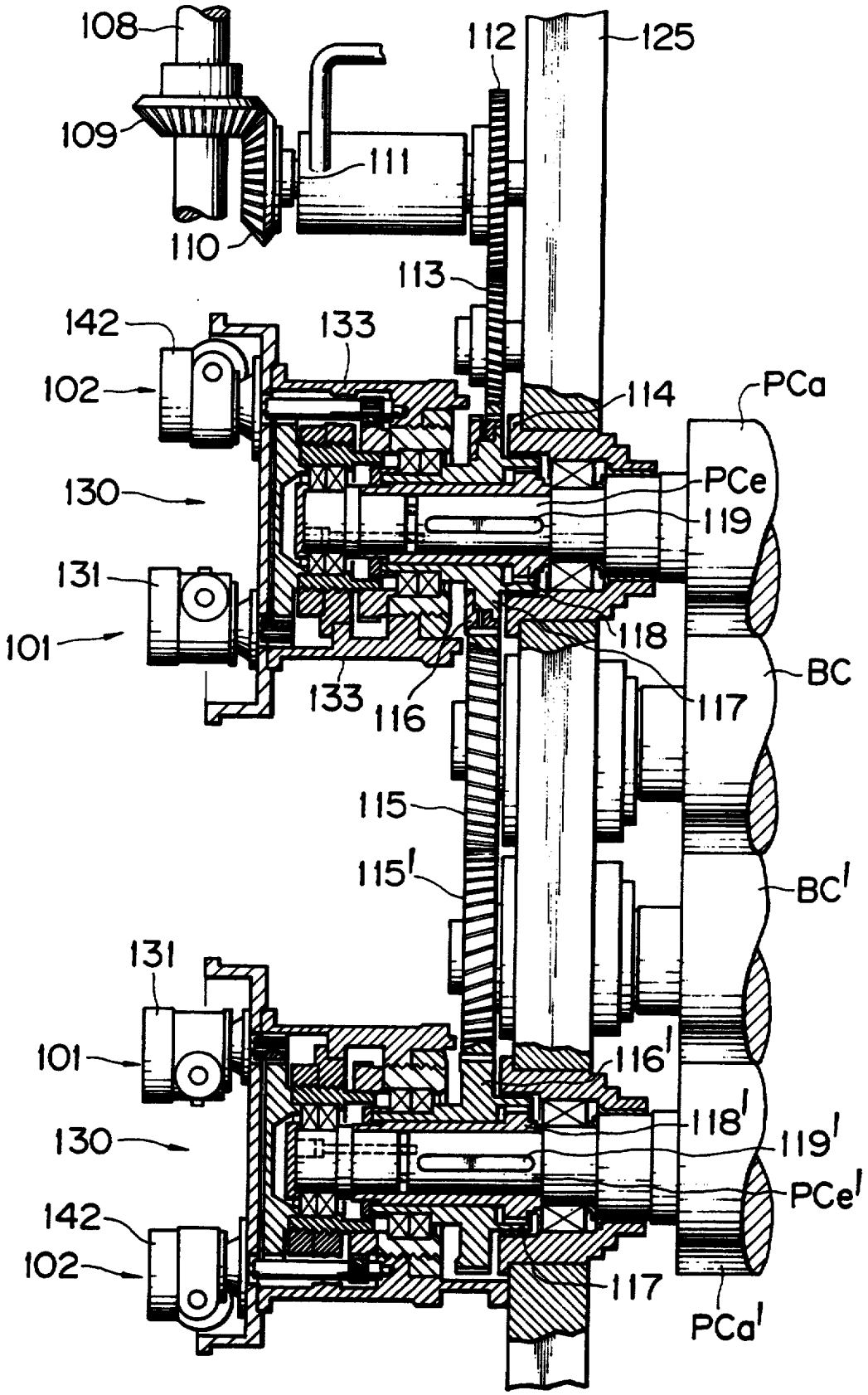
FIG. 7 is a sectional view showing a drive mechanism for one side of the divided plate cylinder and the blanket cylinder associated in the multicolor lithographic rotary press shown in FIG. 1.
Figure 8:
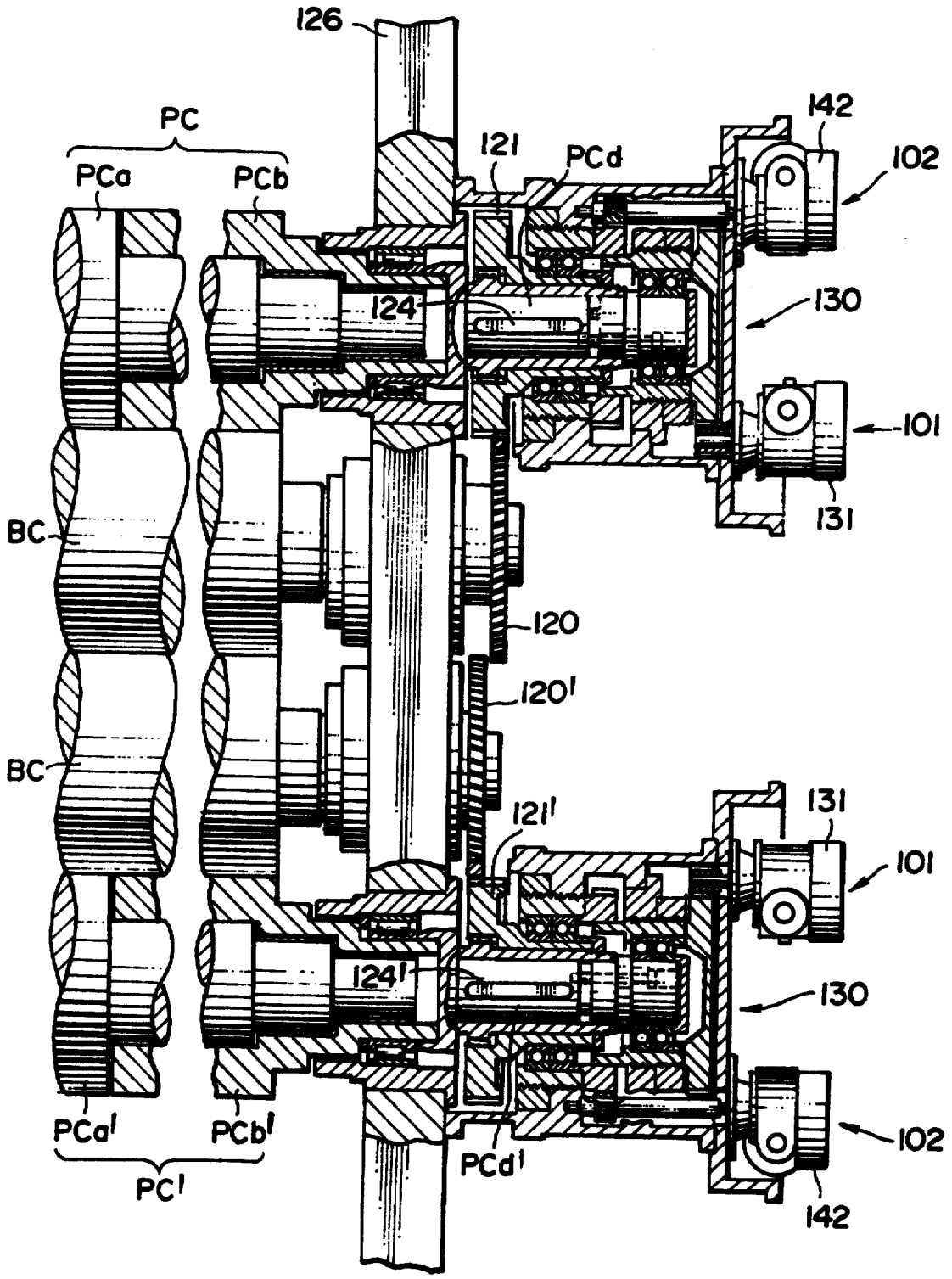
FIG. 8 is a sectional view showing a drive mechanism for the other side of the divided plate cylinder and the blanket cylinder associated in the multicolor lithographic rotary press shown in FIG. 1.
Figure 9:
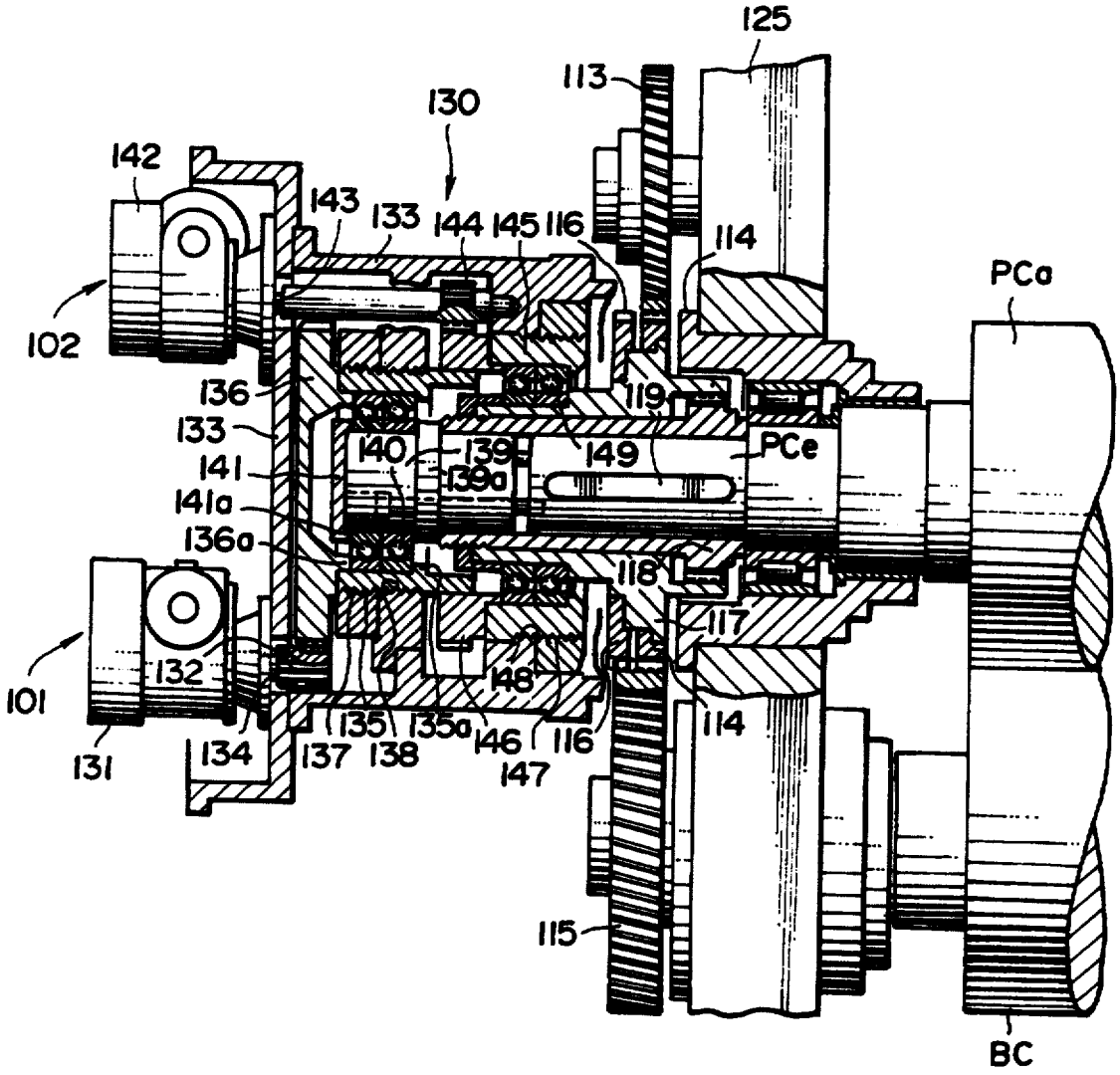
FIG. 9 is an enlarged sectional view of the drive mechanism shown in FIG. 7, which shows an adjusting means for fine-controlling the divided plate cylinder in its circumferential direction.

Next, FIG. 7 and FIG. 8 show one embodiment of register adjusting mechanism for one printing section of the divided plate cylinder type printing apparatus according to the present invention. FIG. 7 is a partially sectional view showing one side structure adjacent to the drive system of the printing apparatus, hereinafter referred to "drive system side structure". On the other hand, FIG. 8 shows the other side structure, referred to "operation side structure". Further FIG. 9 shows an enlarged section of an essential part of the register adjusting unit 130 shown in FIG. 7.

In FIG. 7, a drive shaft 108 transmits drive force from a power source, not shown, to a first helical gear 112 through a bevel gear engagement between a first bevel gear 109 fixed on the drive shaft 108 and a second bevel gear 110 fixed on one end of a shaft 111 whose the other end is fixed to the first helical gear 112. The drive force is further transmitted to a second helical gear 113 engaged with the first helical gear 112. The second helical gear 113 is engaged with a third helical gear 114 which is concentric to a plate cylinder PCa and can be rotated regardless of the plate cylinder PCa. The third helical gear 114 gear is engaged with a fourth helical gear 115 which is fixed to a shaft of a first blanket cylinder BC. According to this mechanical engagement, the drive force makes the blanket cylinder BC rotate.

Further the fourth helical gear 115 is engaged with a fifth helical gear 115' fixed to a second blanket cylinder BC' so that the drive force makes the second blanket cylinder BC' rotate.

The drive force is also transmitted to a sixth helical gear 116 fixed to a shaft PCe to rotate the plate cylinder PCa. On the same occasion, the drive force is transmitted from the fifth helical gear 115' to a seventh helical gear 116' fixed to another shaft PCe' to rotate the plate cylinder PCa'.

In this embodiment, since two plate cylinders PC and PC' are respectively divided into two sections PCa, PCa' and PCb, PCb', the drive force is respectively transmitted to shafts PCd and PCd' for the divided sections PCb and PCb' through the engagement between helical gears 120 and 121, and helical gears 120' and 121' in the operation side structure as shown in FIG. 8. Thus the divided plate cylinders PCb and PCb' are driven.

In FIG. 7 and FIG. 8, the reference numerals 125 and 126 denote a drive system side frame and an operation side frame, respectively.

The register adjusting unit 130 includes a first adjusting means 101 for reciprocally shifting the divided plate cylinder in the axial direction and a second adjusting means 102 for moving the plate cylinder in its circumferential direction.

The first adjusting means 101 is set for each of the divided plate cylinders PCa, PCa', PCb, PCb' to independently shift the cylinder in the axial direction. According to this shifting motion, the register errors in the printed lines and images can be corrected in the width direction of the paper web W.

The structure of the first adjusting means 101 will be described in detail with referring to FIG. 9. The first adjusting means 101 includes a shift-drive unit 131 which is supported by a bracket 133 protruded outwardly from the frame 125 (or 126) to rotatingly drive a pinion gear 134 fixed to an output shaft 132 of the shift-drive unit 131. The pinion gear 134 is engaged with a large diameter gear 136 integrally fixed to a bearing holder 135 to transmit the drive force from the pinion gear 134 to the large diameter gear 136. The bearing holder 135 is formed in the external surface of the holder 135 with a male screw 137 which is engaged with a female screw 138 integrally formed with the bracket 133. According to this arrangement, the bearing holder 135 is shifted in the axial direction on the same occasion of the rotation owing to the female screw 138. On the other hand, the shaft PCe of the divided plate cylinder PCa is further provided with an auxiliary shaft 139. The shafts PCe', PCd, and PCd' of the divided plate cylinders PCa', PCb, and PCb' have the same structure as the shaft PCe of the divided plate cylinder PCa, so that the same explanation is not repeated. The auxiliary shaft 139 is rotatably supported by the bearing holder 135 through a bearing 140. Both ends of the bearing 140 are restricted between a projecting section **135*a* formed on the bearing holder 135 and another projecting section 136*a* formed on the large diameter gear 136, and further between a large diameter section 139*a* of the auxiliary shaft 139 and an annular end 141*a* of a shaft end cap 141. As a result, the shift motion of the bearing holder 135 in the axial direction is transmitted to the divided plate cylinder PCa through the bearing 140, the auxiliary shaft 139** and the shaft PCe so that the divided plate cylinder PCa is finely shifted in the axial direction.

The structure of the second adjusting means 102 will be also described in detail with referring to FIG. 9. Since the second adjusting means 102 is arranged to each of the divided plate cylinders PCa, PCa', PCb, and PCb' and has the same structure, the description is discussed on only the cylinder PCa.

The second adjusting means 102 includes a drive unit 142 which is supported by the bracket 133 protruded outwardly from the frame 125 (or 126) to rotatingly drive a pinion gear 144 fixed to an output shaft 143 of the shift-drive unit 144. The pinion gear 144 is engaged with a large diameter gear 146 integrally fixed to a bearing holder 145 to transmit the drive force from the pinion gear 144 to the large diameter gear 146. The bearing holder 145 is formed in the external surface of the holder 145 with a male screw 147 which is engaged with a female screw 148 integrally formed with the bracket 133. According to this arrangement, the bearing holder 145 is shifted in the axial direction on the same occasion of the rotation owing to the female screw 148. In the bearing holder 145, an internal gear member 117 is rotatably supported through a bearing 149 whose ends are restricted. The internal gear member 117 is engaged with an external gear member 118 which is integrally fixed with the shaft PCe through a key 119 to allow the internal gear member 117 to slidingly move in the axial direction. The internal gear member 117 is further provided with the helical gear 116 for driving the divided plate cylinder PCa. The helical gear 116 is engaged with the helical gear 115 for driving the blanket cylinder. According to this arrangement, the shift motion of the internal gear member 117 in the axial direction is converted into a revolving motion in the circumferential direction on account of the helical direction of the helical gear 115. As a result, the divided plate cylinder PCa is finely rotated in its circumferential direction.

Figure 10:
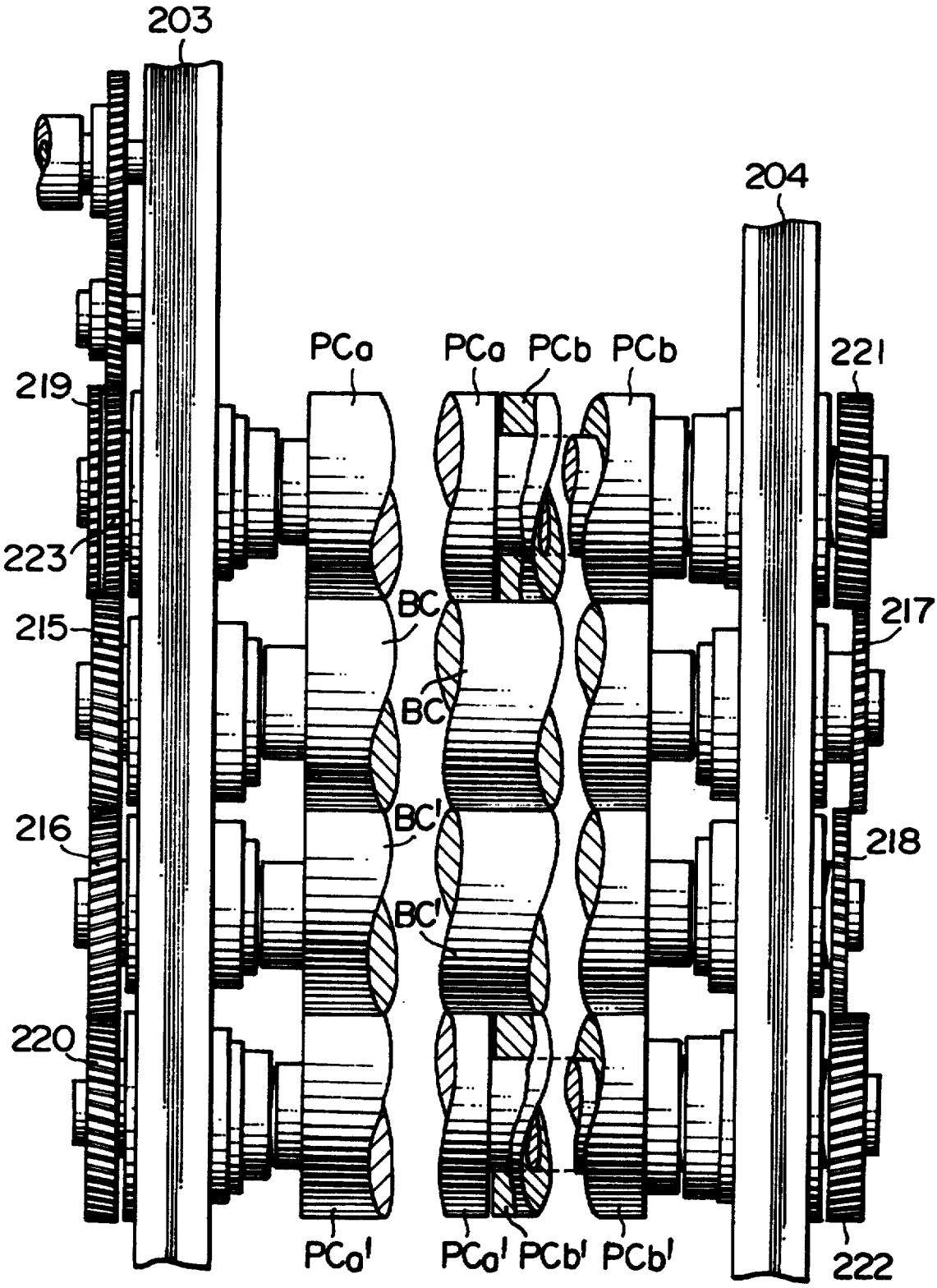
FIG. 10 is a partial plan view showing a mechanical relation between the divided plate cylinders and the drive unit of B—B type printing apparatus according to the present invention.

FIG. 10 shows an essential structure of the drive-mechanism for one printing section with two divided plate cylinders in B—B type printing apparatus. Between a pair of drive side frame 203 and operation side frame 204, the divided plate cylinders PCa, PCb and the blanket cylinder BC are oppositely arranged to be capable of moving in close to and apart from each other. The divided plate cylinders PCa', PCb' and the blanket cylinder BC' are arranged in the same as the above. Each of the divided plate cylinders is provided with an inking unit and/or a dampening unit, not shown.

In this embodiment shown in FIG. 10, the external diameter of the blanket cylinder BC (BC') finally arranged is slightly smaller than that of the divided plate cylinders PCa, PCb (PCa', PCb').

The blanket cylinder BC is fixed at its both ends to helical gears 215 and 217 which are meshingly engaged with driven gears 219 and 221 fixed to both ends of the divided plate cylinders PCa, PCb. Also the blanket cylinder BC' is fixed at its both ends to helical gears 216 and 218 which are meshingly engaged with driven gears 220 and 222 fixed to both ends of the divided plate cylinders PCa', PCb'. The helical gears 215 and 216 of the blanket cylinders BC and BC' at the drive side are engaged with each other. One of the helical gears 215 and 216 (in this embodiment, 215) is engaged with an intermediate gear 223 mechanically connected to a power source, not shown. The intermediate gear 223 is rotatably supported by the shaft of the driven gear 219.

In the above described arrangement, the divided plate cylinders PCa, PCb and PCa', PCb' having larger diameter are always driven because the driven gears 219, 220, 221 and 222 fixed to the ends of the divided plate cylinders PCa, PCb and PCa', PCb' are driven by the helical gears 215, 216, 217 and 218 fixed to the ends of the blanket cylinders BC and BC'.

Figure 11:
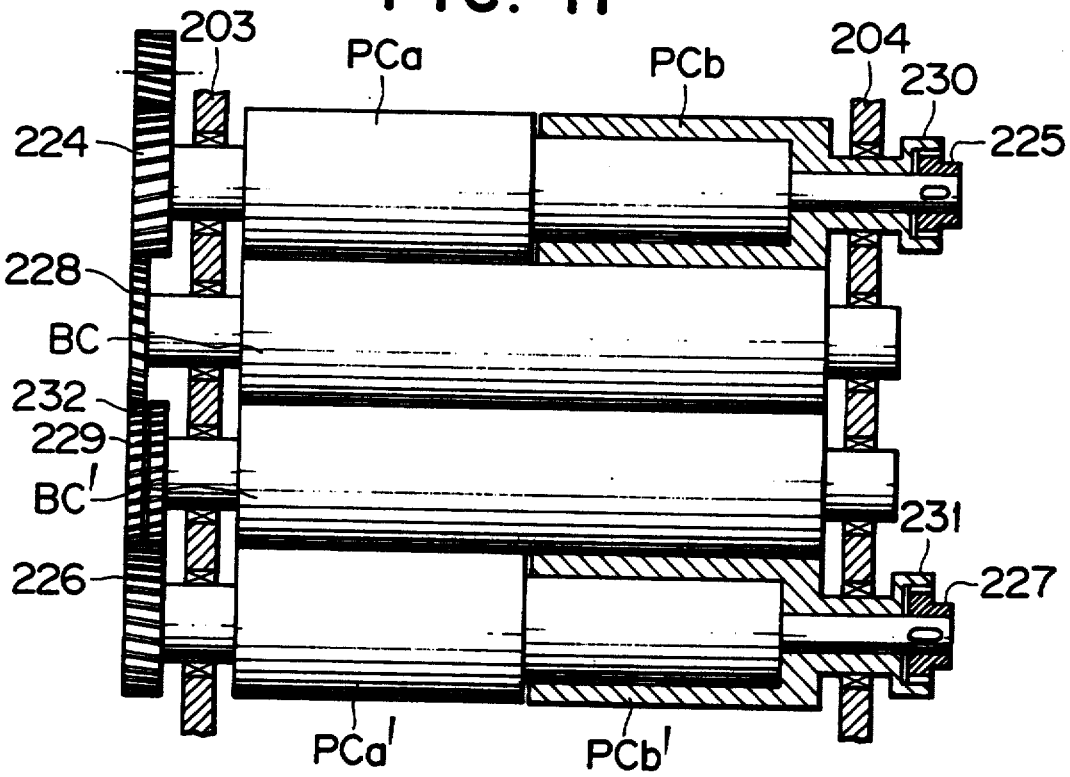
FIG. 11 is a schematically partial sectional view showing a mechanical relation between the divided plate cylinders and the drive unit of B—B type printing apparatus according to the present invention.
Figure 12:
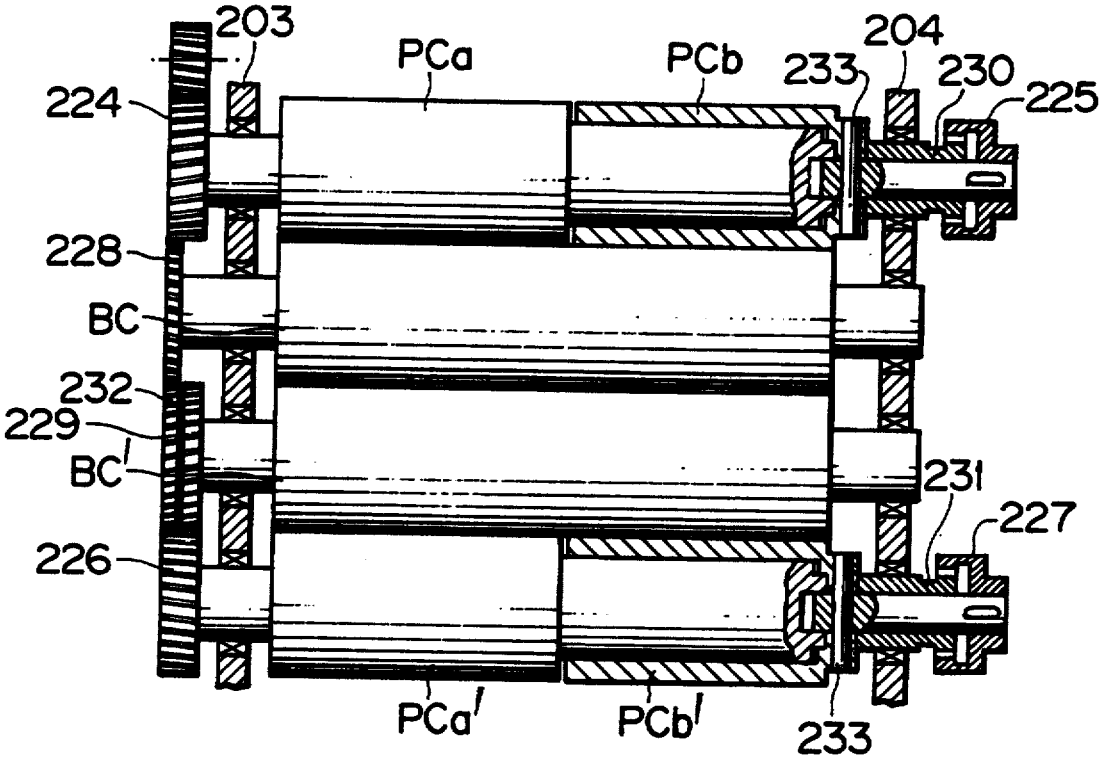
FIG. 12 is a schematically partial sectional view showing another mechanical relation between the divided plate cylinders and the drive unit of B—B type printing apparatus according to the present invention.
Figure 13:
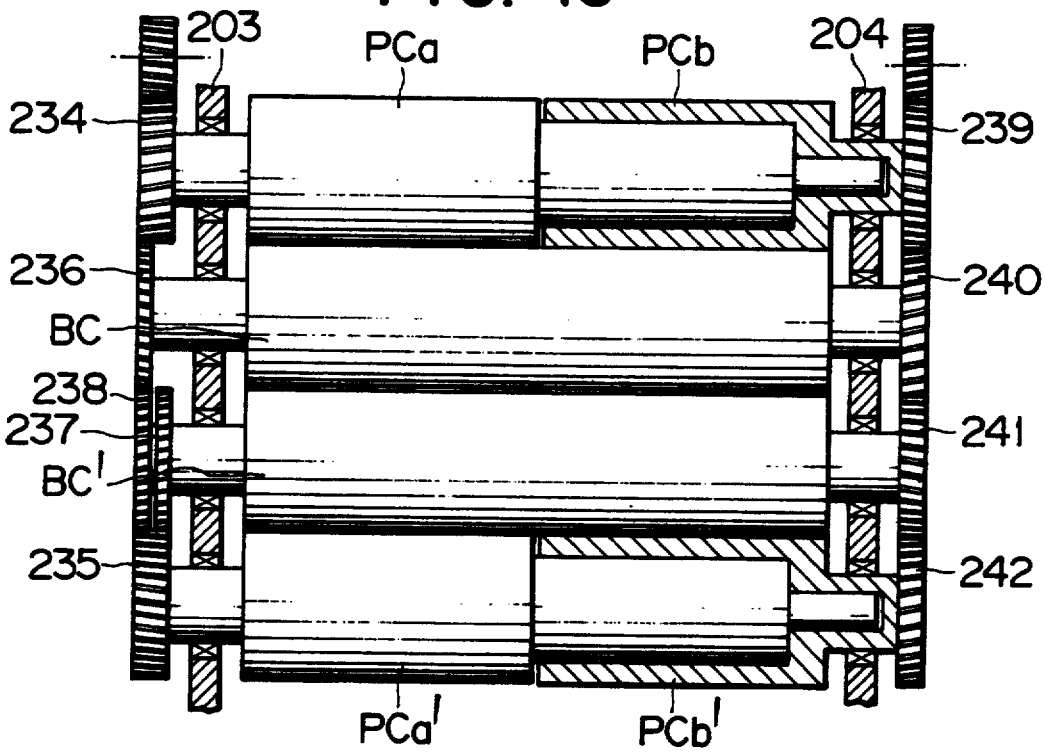
FIG. 13 is a schematically partial sectional view showing other mechanical relation between the divided plate cylinders and the drive unit of B—B type printing apparatus according to the present invention.
Figure 18:
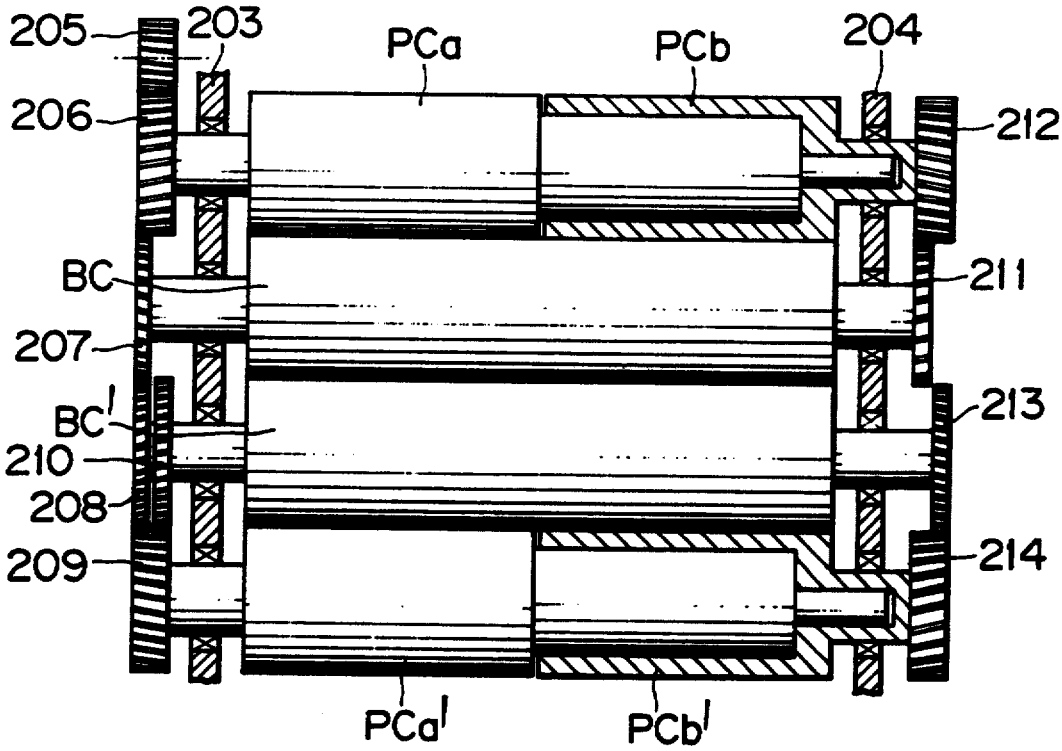
FIG. 18 PRIOR ART
FIG. 18 is a schematically partial sectional view showing a mechanical relation between the divided plate cylinders and the drive unit of a conventional B—B type printing apparatus without any idle rotation preventing means.
Figure 14:
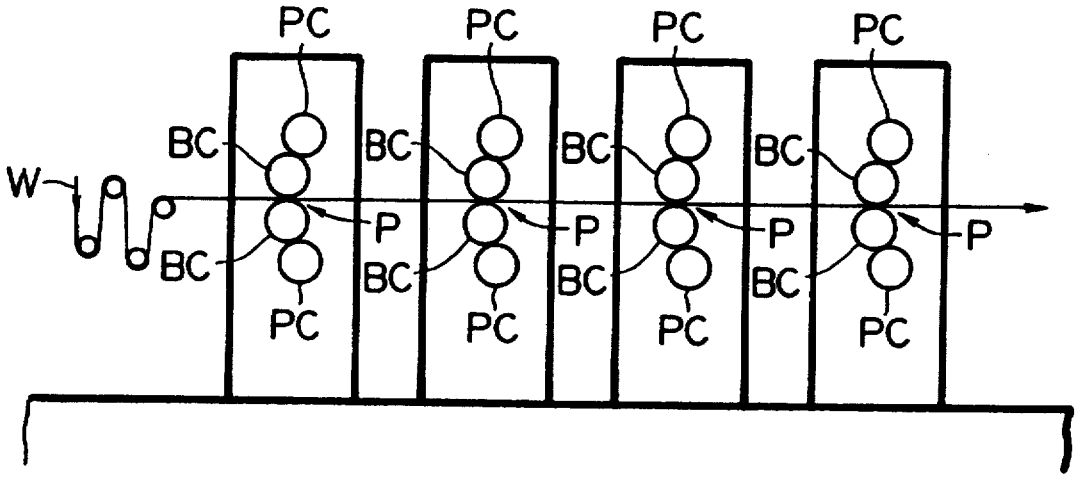
FIG. 14 PRIOR ART
FIG. 14 is a schematic illustration showing an overall construction of one example of conventional lithographic rotary press.
Figure 15:
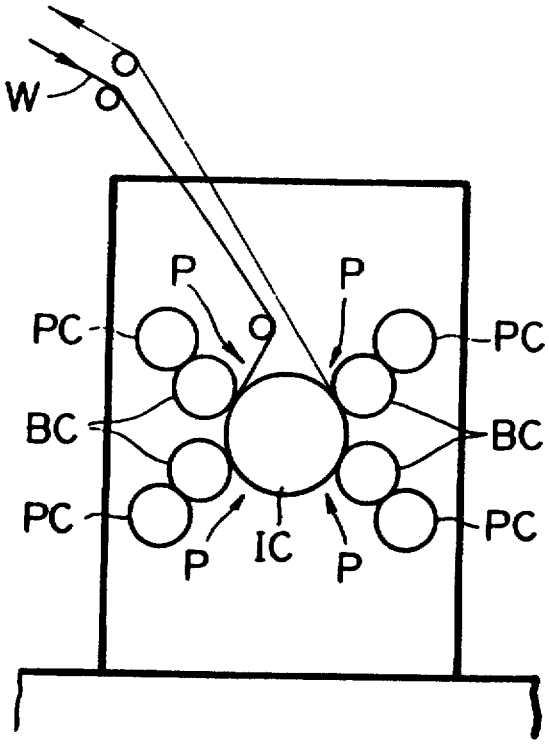
FIG. 15 PRIOR ART
FIG. 15 is a schematic illustration showing an overall construction of another example of conventional lithographic rotary press.
Figure 16:
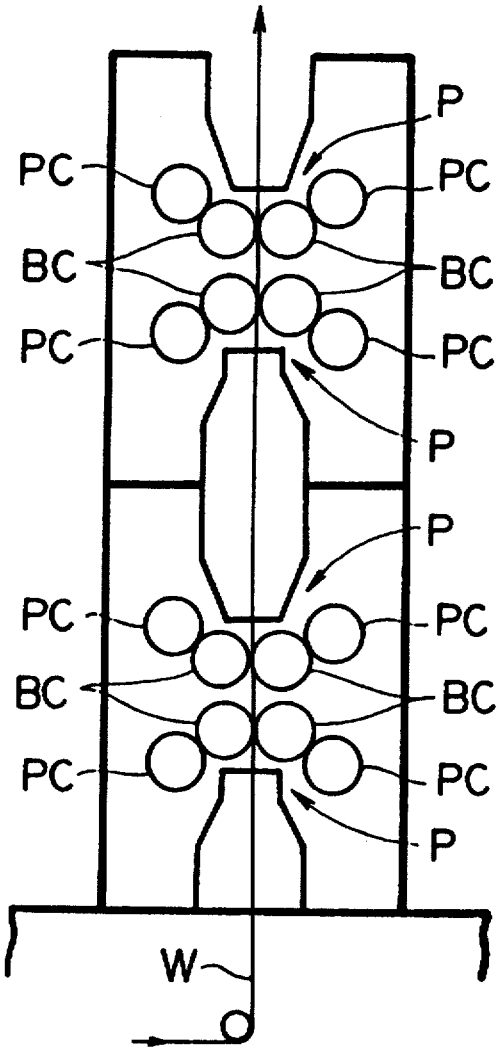
FIG. 16 PRIOR ART
FIG. 16 is a schematic illustration showing an overall construction of another example of conventional lithographic rotary press.

FIG. 11 to FIG. 13 show various modifications of drive mechanism for the B—B type printing section in which the external diameter of the blanket cylinders BC, BC' finally arranged is slightly larger than that of the divided plate cylinders PCa, PCb, PCa', PCb'.

In FIG. 11, the divided plate cylinders PCa, PCb, PCa' and PCb' are respectively provided at their end with transmission gears 224, 225, 226 and 227. The blanket cylinders BC and BC' are also provided at their one end with driven gears 228 and 229 which are engaged with the transmission gears 224 and 226, respectively. The divided plate cylinders PCb and PCb' are provided at the operation side with driven internal gears 230 and 231 which are engaged with the transmission gears 225 and 227, respectively. Further, at the drive side of one of the blanket cylinders, BC' in this embodiment, an intermediate gear 232 is rotatably mounted on the shaft of the driven gear 229 and engaged with the driven gear 228 of the blanket cylinder BC and the transmission gear 226 fixed to the divided plate cylinder PCa'. The transmission gear 224 is mechanically connected to a power source, not shown.

FIG. 12 shows essentially the same structure as FIG. 11 except that the driven internal gears 230 and 231 are replaced by driven external gears 230 and 231, the transmission gears 225 and 227 are replaced by transmission internal gears 225 and 227. In addition to these differences, the divided plate cylinders PCb and PCb' and their shafts are not integrally formed and thus they need pins 233 and 233 to assemble into one piece.

In the above described arrangements, the blanket cylinders BC and BC' having a larger diameter are always driven and the divided plate cylinders PCb and PCb' having a larger diameter are transmitted with the drive force from the divided plate cylinders PCa, PCa' having the same diameter. Therefore undesirable idle rotation is not generated between the divided plate cylinders and the blanket cylinders.

FIG. 13 shows two drive systems for individually transmitting the drive force from a power source, not shown, to the left side drive unit and the right side drive unit.

In the left side drive unit shown in FIG. 13, the divided plate cylinders PCa and PCa' are securely provided at their shaft ends with transmission gears 234 and 235, respectively. Also the blanket cylinders BC and BC' are securely provided at their shaft ends with driven gears 236 and 237 which are engaged with the transmission gears 234 and 235. Further, an intermediate gear 238 is rotatably mounted on the shaft of the driven gear 236 and 237, in this embodiment 237, and engaged with the driven gear 236 and the transmission gear 235 fixed to the divided plate cylinder PCa'. The transmission gear 234 is mechanically connected to a power source, not shown. In this arrangement, the drive force is always transmitted from the divided plate cylinders PCa and PCa' having a smaller diameter to the blanket cylinders BC and BC' having a larger diameter, so that undesirable idle rotation is not generated between the divided plate cylinders and the blanket cylinders.

On the other hand, in the right side drive unit, a transmission gear 239 fixed to the right end of the divided plate cylinder PCb is mechanically connected to a power source, not shown, and engaged with an intermediate gear 240 which is rotatably mounted on the right end of the shaft of the blanket cylinder BC. Further the intermediate gear 240 is engaged with another intermediate gear 241 which is rotatably mounted on the right end of the shaft of the blanket cylinder BC'. The intermediate gear 241 is engaged with a driven gear 242 which is securely mounted on the right end of the divided plate cylinder PCb'. In this drive mechanism, the drive force is always transmitted to the divided plate cylinders PCb' having a smaller diameter from the divided plate cylinders PCb having the same diameter as the above without the blanket cylinders having a larger diameter, so that undesirable idle rotation is not generated between the divided plate cylinders and the blanket cylinders.

In other words, the drive mechanism for the B—B type printing section shown in FIG. 13, the drive force is always transmitted from the smaller diameter cylinders as the driving means to the larger diameter cylinders as the driven means, or from the smaller diameter cylinder as the driving means to the smaller diameter cylinder as the driven means. Thus this arrangement secures that undesirable idle rotation is not generated between the divided plate cylinders and the blanket cylinders, so that a clear and sharp printed material can be constantly produced.

Returning to FIG. 1, the register adjusting mechanisms arranged for the printing sections as discussed before are controlled by the control unit 402 connected to the sensor 401 which detects any reference marks such as a register mark printed on the paper web W by the printing sections. The control unit 402 is for example a microprocessor which compares the detected data from the sensor 403 with a predetermined value and outputs an adjusting signal for each of the printing sections. The control unit 402 is electrically connected to each drive motor of the drive mechanisms for the divided plate cylinders. According to the adjusting signal from the control unit 402, the divided plate cylinders PCa, PCa', PCb and PCb' are individually controlled in reciprocally shifting in the axial direction and revolving in the circumferential direction so as to eliminate the register errors in the printed images and lines.

The control unit 402 is further connected to an operation unit 403 through which an operator inputs various information such as starting or stopping command, and so on.

As is understood from the above described explanation, the web width adjusting system according to the present invention can generate wave-forming to cancel the expanded width owing to dampening operation. According to this web width adjusting function, the register errors of printed images and lines generated in the printing operations can be adequately corrected.

Since the printing apparatus according to the present invention includes the paper stretching means, the paper web can be always applied with a constant stretching force even when the paper web is accidentally released from the cylinders in the printing section. Thus the paper drawing means secures the web width adjusting operation prior to the printing section.

The external tubular member of the paper drawing means is rotated in synchronism with the paper web traveling speed so that the printed surface of the paper web is not injured by a violent rotation of the external tubular member.

The printing apparatus according to the present invention further includes the register adjusting means which checks the register errors in the printed images and lines after the final printing step, and individually adjusts the divided cylinders in reciprocally shifting in the axial direction and revolving in the circumferential direction so as to eliminate the register errors in the printed images and lines.

As a result, the printing apparatus according to the present invention can always produce printed materials with sharp and clear images and lines. Additionally, the above described correcting operations are automatically performed to decrease cost and improve printing efficiency.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A multicolor lithographic rotary press comprising:
a plurality of printing sections vertically arranged along a traveling line of paper web;
a plurality of register adjusting means for correcting register errors;
a paper drawing means for drawing the paper web through the printing sections; and
a plurality of width adjusting means for adjusting the width of the paper web;
wherein each of said printing sections further includes at least one divided plate cylinder having a plurality of divided sections, each said divided section being independently moved in at least one of an axial direction and a circumferential direction;
wherein said paper drawing means is arranged downstream of said printing sections and includes at least one roller member whose circumferential surface is in contact with the paper web to apply a drawing force to the paper web;
wherein each said width adjusting means is arranged between a respective two sets of said printing sections to apply an adjusting force to the paper web; and
wherein said register adjusting means is mechanically connected to each of said divided plate cylinders in said printing sections, and includes an adjusting mechanism for actuating said divided sections individually in response to a control unit connected to a sensor for detecting lines and images printed on the paper web by each of said printing sections.

2. The multicolor lithographic rotary press according to claim 1, wherein said paper drawing means includes a support shaft having a stationary member, and an external tubular member provided with a rotator, said tubular member being rotatably supported by said support shaft by electric energy.

3. The multicolor lithographic rotary press according to claim 1, wherein the paper web has opposite major surfaces on which the printing sections print lines and images, and wherein each of said width adjusting means includes a pair of contact units, one unit of the pair disposed opposite each major surface of the paper web.

4. The multicolor lithographic rotary press according to claim 3, wherein said pair of contact units includes contact rollers alternately arranged on the opposite major surfaces of the paper web.

5. The multicolor lithographic rotary press according to claim 3, wherein said pair of contact units includes fluid ejecting members alternately arranged on the opposite major surfaces of the paper web.

* * * * *